US008328448B1

(12) United States Patent
Hufnagel

(10) Patent No.: US 8,328,448 B1
(45) Date of Patent: Dec. 11, 2012

(54) HARDWARE HOLE FILLING DEVICE

(76) Inventor: Randall S. Hufnagel, Eighty Four, PA (US)

( * ) Notice: Subject to any disclaimer, the term of this patent is extended or adjusted under 35 U.S.C. 154(b) by 61 days.

(21) Appl. No.: 12/797,533

(22) Filed: Jun. 9, 2010

(51) Int. Cl.
*B65D 83/76* (2006.01)

(52) U.S. Cl. ..... 401/172; 401/174; 401/176; 425/12

(58) Field of Classification Search ..... 425/12, 425/13, DIG. 32; 401/68, 69, 143, 172, 171, 401/174, 176, 183; 52/514, 514.5; 222/386
See application file for complete search history.

(56) References Cited

U.S. PATENT DOCUMENTS

| | | | | | |
|---|---|---|---|---|---|
| 416,659 | A | * | 12/1889 | Wells et al. | 401/172 |
| 783,963 | A | * | 2/1905 | Kennedy | 401/172 |
| 1,055,028 | A | * | 3/1913 | Flynn et al. | 222/205 |
| 1,495,800 | A | * | 5/1924 | Recker | 401/82 |
| 1,499,784 | A | * | 7/1924 | Recker | 401/75 |
| 1,867,558 | A | * | 7/1932 | Atwood | 427/277 |
| 2,559,553 | A | * | 7/1951 | Wolff | 401/172 |
| 2,818,167 | A | * | 12/1957 | McKinley | 401/75 |
| 3,173,170 | A | * | 3/1965 | Reusch | 156/538 |
| 3,907,441 | A | * | 9/1975 | Idec et al. | 401/75 |
| 3,961,731 | A | * | 6/1976 | Mochida | 222/390 |
| 4,047,497 | A | * | 9/1977 | Grobler | 118/50 |
| 4,278,360 | A | * | 7/1981 | Lorscheid et al. | 401/151 |
| 4,363,560 | A | * | 12/1982 | Gentile | 401/68 |
| 4,465,648 | A | | 8/1984 | Kiriyama et al. | |
| 4,595,124 | A | * | 6/1986 | Duval et al. | 222/39 |
| 4,767,025 | A | * | 8/1988 | Gebauer et al. | 222/135 |
| 5,007,755 | A | * | 4/1991 | Thompson | 401/175 |
| 5,085,352 | A | * | 2/1992 | Sasaki et al. | 222/327 |
| 5,186,949 | A | | 2/1993 | Lai | |
| 5,505,041 | A | * | 4/1996 | Harlan | 53/473 |
| 5,809,736 | A | | 9/1998 | Naito et al. | |
| 5,948,444 | A | * | 9/1999 | Naito et al. | 425/13 |
| 7,021,913 | B1 | | 4/2006 | Sneed | |
| 7,194,847 | B2 | * | 3/2007 | Summons et al. | 53/433 |
| D570,913 | S | | 6/2008 | Kusaba | |
| 7,686,192 | B1 | * | 3/2010 | Patton et al. | 222/390 |
| 8,235,257 | B2 | * | 8/2012 | Avairis | 222/390 |
| 2002/0081137 | A1 | * | 6/2002 | Butz et al. | 401/143 |
| 2002/0159819 | A1 | * | 10/2002 | Werhahn et al. | 401/88 |
| 2003/0057236 | A1 | * | 3/2003 | Delage | 222/390 |
| 2003/0170067 | A1 | * | 9/2003 | Reggiani | 401/264 |
| 2004/0201212 | A1 | * | 10/2004 | Marks | 285/124.1 |
| 2006/0072956 | A1 | * | 4/2006 | Tanaka et al. | 401/75 |
| 2006/0204314 | A1 | * | 9/2006 | Murakoshi | 401/87 |
| 2008/0050168 | A1 | * | 2/2008 | Groh et al. | 401/68 |
| 2008/0050169 | A1 | * | 2/2008 | Nasu | 401/68 |
| 2008/0097244 | A1 | * | 4/2008 | Arnitz | 600/583 |
| 2009/0003920 | A1 | * | 1/2009 | Zukowski et al. | 401/68 |
| 2009/0052968 | A1 | * | 2/2009 | Welschoff | 401/75 |
| 2010/0104346 | A1 | * | 4/2010 | Tani | 401/68 |
| 2011/0033220 | A1 | * | 2/2011 | Arai et al. | 401/68 |
| 2011/0318085 | A1 | * | 12/2011 | Alcocer | 401/143 |

* cited by examiner

*Primary Examiner* — Yogendra Gupta
*Assistant Examiner* — Emmanuel S Luk

(57) ABSTRACT

A hardware hole filling device featuring a tube having an inner cavity for holding a filling; a tip disposed on the first end of the tube; a tip nozzle removably attached to the tip of the tube; a removably screw cap for covering the tip nozzle; and a riser mechanism functioning to push the filling from the inner cavity of the tube to the tip nozzle, the riser mechanism involves a threaded riser shaft, a riser threaded on the riser shaft, and a shaft base, the riser shaft can be moved in a first direction and a second direction by twisting the shaft base causing the riser to moved upwardly and downwardly, respectively, on the riser shaft, when the riser is moved upwardly the filling in the inner cavity of the tube is pushed to the tip nozzle.

7 Claims, 3 Drawing Sheets

HARDWARE HOLE FILLING DEVICE

FIELD OF THE INVENTION

The present invention is directed to hardware devices for wall or other surfaces, more particularly to a device for filling and/or repairing holes (e.g., nail holes) in wall surfaces including plaster, drywall, wood, and the like.

BACKGROUND OF THE INVENTION

Filling nail holes (or holes from other hardware including screws, bolts, and the like) in drywall, wood, plaster, and the like, is an important step in many projects. Filling such holes can be a messy process. The present invention features a hardware hole filling device for filling such holes. The device of the present invention can also be used for other tasks, for example for repairing the holes prior to filling. In some cases, the device can be used to seal holes (e.g., nail holes) in hotel rooms or other locations where a camera may be hidden. The device of the present invention is compact and durable, easy to use (and thus time-saving), and generally mess-free.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a hardware hole filling device. In some embodiments, the device comprises a tube having a first end, a second end, and an inner cavity, the inner cavity holds a filling; a tip disposed on the first end of the tube, the tip is fluidly connected to the inner cavity of the tube; a tip nozzle removably attached to the tip of the tube; threads disposed on the first end of the tube; a screw cap for removably attaching to the tube via the threads, the screw cap functions to cover the tip nozzle when attached to the tube; a base cap removably attached to the second end of the tube; and a riser mechanism functioning to push the filling from the inner cavity of the tube to the tip nozzle, the riser mechanism comprises: (i) a threaded riser shaft, (ii) a riser threaded on the riser shaft, and (iii) a shaft base, the threaded riser shaft is attached to the shaft base, the riser shaft extends into the inner cavity of the tube from the second end upwardly toward the first end, the riser is snugly in contact with an inner wall of the inner cavity of the tube, the filling is sandwiched between the riser and the tip nozzle and the shaft base is positioned externally to the second end of the tube and the base cap, the riser shaft can be moved in a first direction and a second direction by twisting the shaft base causing the riser to moved upwardly and downwardly, respectively, on the riser shaft, when the riser is moved upwardly the filling in the inner cavity of the tube is pushed to the tip nozzle.

In some embodiments, the filling is spackle, putty, wood putty, drywall composition, or wood glue. In some embodiments, the first end of the tube is beveled. In some embodiments, the tip nozzle is generally cylindrical. In some embodiments, the tip nozzle has a flat end. In some embodiments, the riser is snugly in contact with the inner wall of the inner cavity of the tube in combination with a first gasket. In some embodiments, a second gasket is sandwiched between the shaft base and the base cap.

The present invention also features a method of repairing a hole. In some embodiments, the method comprises providing a hardware hole filling device; inserting the nozzle tip into the hole; pressing into an interior area of the hole to force debris into a back area of the hole; and moving the riser mechanism such that the riser pushes filling from the inner cavity of the tube to the tip nozzle and into the hole.

DESCRIPTION OF PREFERRED EMBODIMENTS

Figure 1:
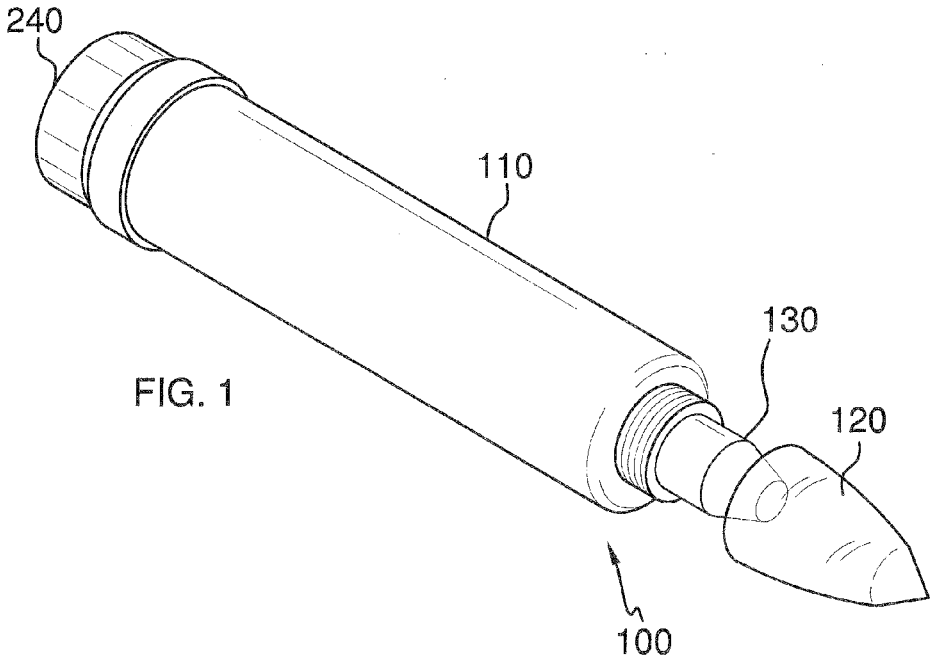
FIG. 1 is a front perspective view of the hole filling device of the present invention.
Figure 2:
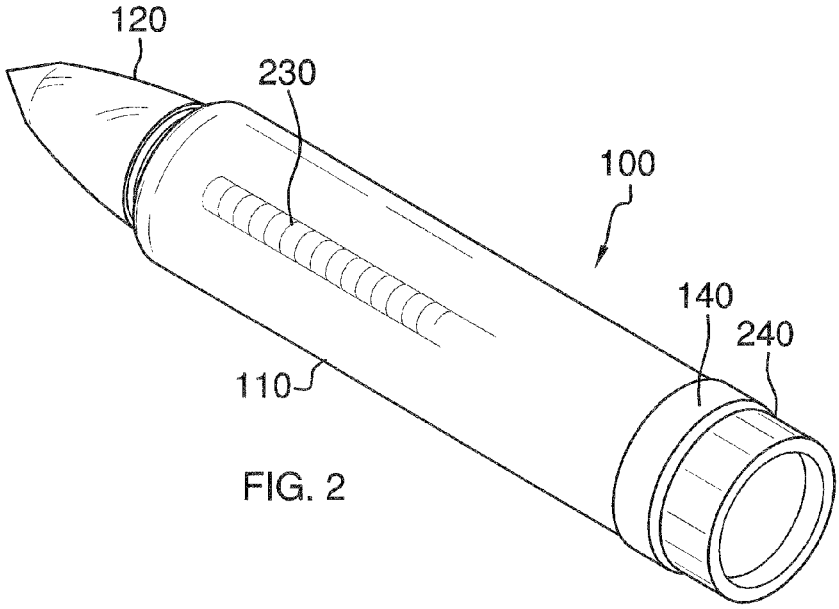
FIG. 2 is a rear perspective view of the hole filling device of FIG. 1.
Figure 3:
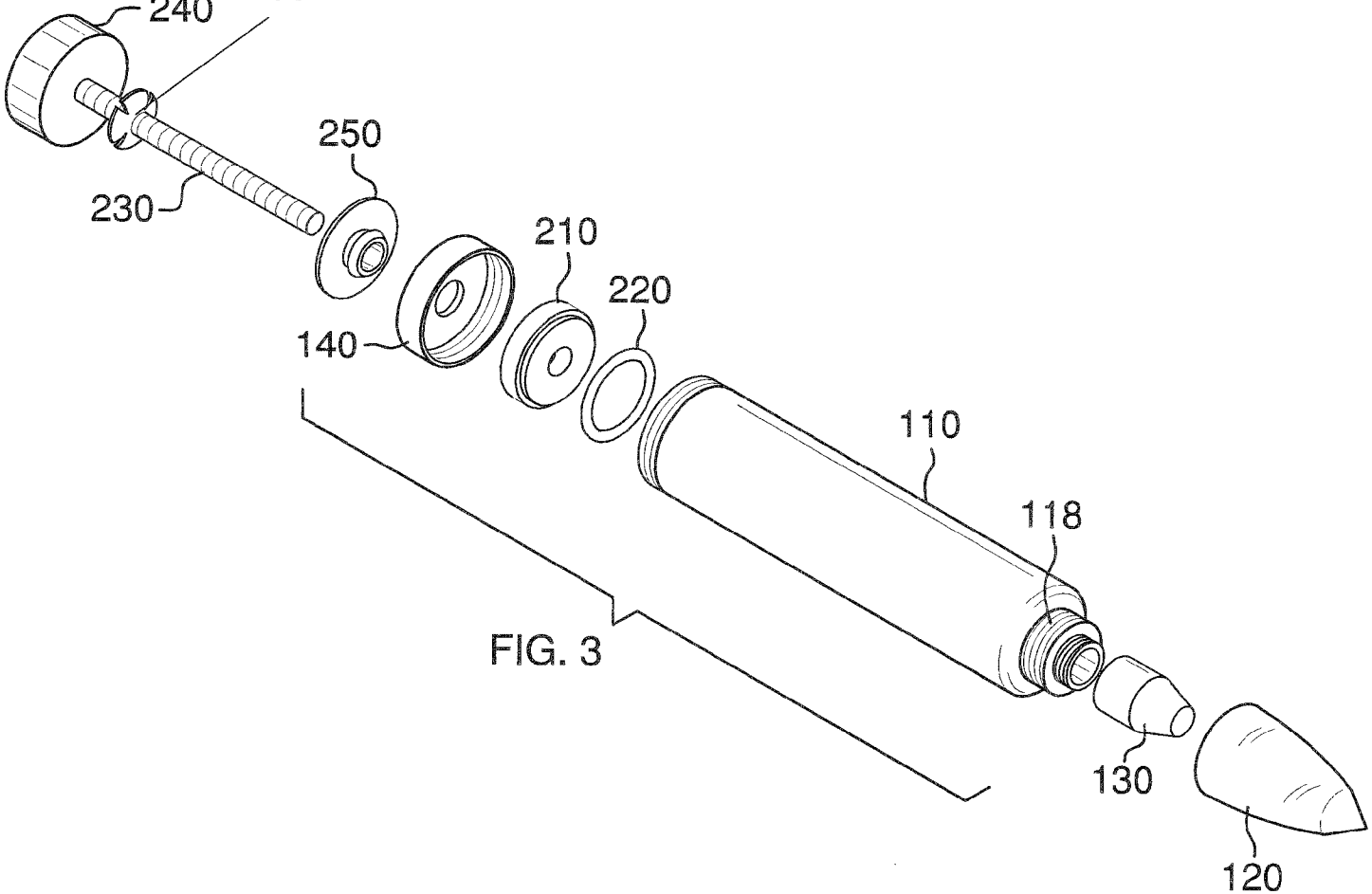
FIG. 3 is an exploded view of the hole filling device of FIG. 1.
Figure 4:
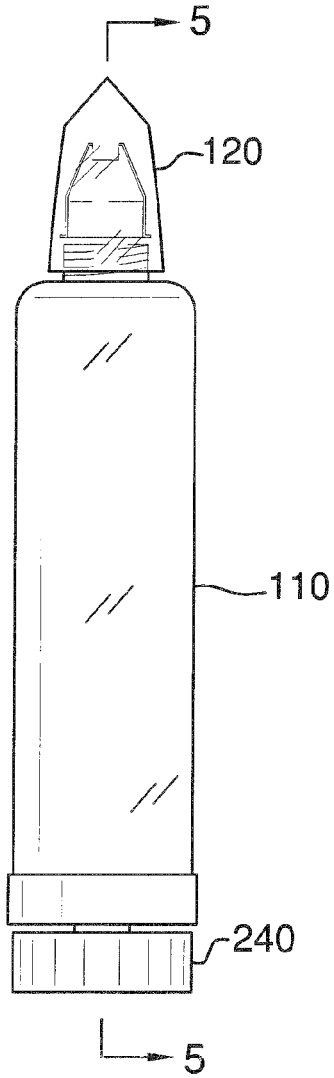
FIG. 4 is a front view of the hole filling device of FIG. 1.
Figure 5:
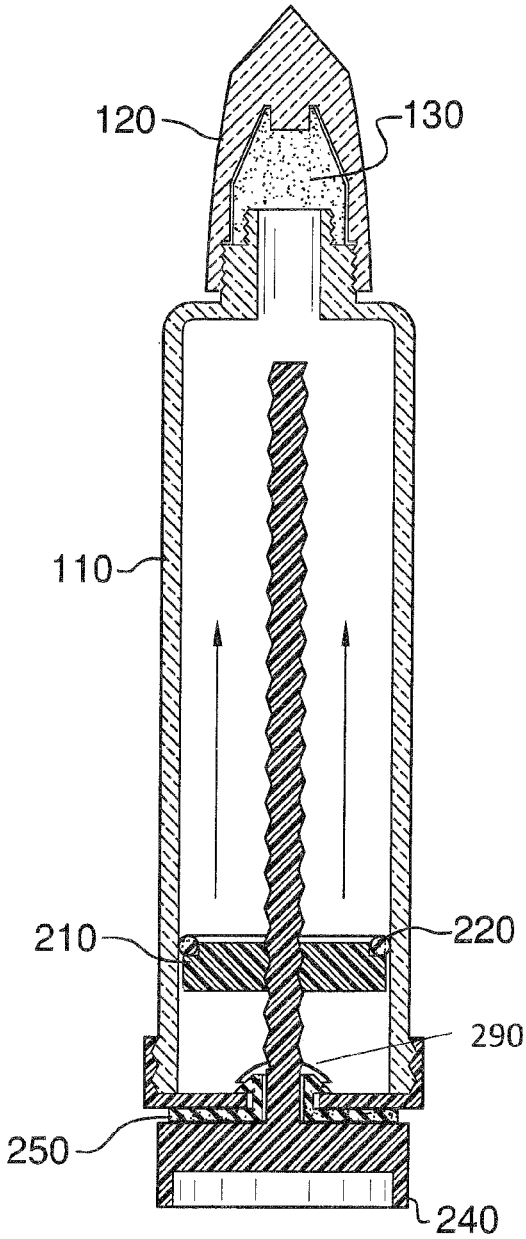
FIG. 5 is a cross sectional view of the hole filling device of FIG. 1.

Referring now to FIGS. 1-5, the present invention features a hardware hole filling device 100 for repairing and/or filling holes from nails (or other hardware including screws, bolts, tacks, and the like) in drywall, wood, plaster, and the like. The holes may be of various sizes, for example between about 1/16 to 1/4 inch in diameter.

The hole filling device 100 of the present invention comprises a housing (e.g., a generally cylindrical tube 110) having a first end, a second end, and an inner cavity. The first end and the second end of the tube 110 are open (e.g., not closed ends). The inner cavity of the tube 110 is for holding a filling, for example spackle, putty, wood putty, drywall composition, wood glue, or other substance. Wood putty, for example, may include cherry, oak, teak, pine, mahogany, and/or the like.

The tube 110 may be constructed from a variety of materials and in a variety of sizes. For example, in some embodiments, the tube 110 is constructed from a material comprising a plastic or the like. The tube 110 may be generally transparent, semi-transparent, translucent, semi-translucent, or opaque. In some embodiments, the tube 110 is between about 2 to 4 inches in length as measured from the first end to the second end. In some embodiments, the tube 110 is between about 4 to 6 inches in length as measured from the first end to the second end. In some embodiments, the tube 110 is more than about 6 inches in length. In some embodiments, the tube 110 is between about 0.5 to 1 inch in diameter. In some embodiments, the tube 110 is between about 1.0 to 1.5 inches (e.g., 1.25 inches) in diameter. In some embodiments, the tube 110 is more than about 1.5 inches in diameter.

In some embodiments, the first end of the tube 110 narrows (e.g., is beveled). A tip is disposed on the first end of the tube 110, the tip being fluidly connected to the inner cavity of the tube 110. A tip nozzle 130 is removably attached to the tip of the tube 110. The filling from the inner cavity of the tube 110 can be transferred to the tip nozzle 130 via the tip of the tube 110. In some embodiments, the tip nozzle 130 is generally cylindrical. In some embodiments, the tip nozzle 130 is shortened or flattened, for example see FIG. 3 wherein the tip nozzle 130 is beveled with a flat end. The cylindrical shape (and/or beveled shape) allows the tip nozzle 130 to be inserted into the hole to be repaired and/or filled. In some embodiments, the tip nozzle 130 is used to push into the hole to prepare the hole for filling.

Disposed on the first end of the tube 110 (e.g., around a portion of the tip) are threads 118 for accommodating a removable screw cap 120. The screw cap 120 can be attached and detached from the threads 118 of the tube 110 as needed. The tip nozzle 130 may be removable, for example allowing a user to insert a filling (e.g., putty, wood glue, etc.) or other material into the inner cavity of the housing 100. In some embodiments, the tip nozzle 130 fills the inner cavity of the screw cap 120 (see FIG. 5) when the screw cap 120 is attached to the tube 110.

Materials or substances in the inner cavity of the tube 110 (e.g., putty, wood glue, drywall material, etc.) can be pushed from the inner cavity of the tube 110 out of the tip nozzle 130 via a riser mechanism. Riser mechanisms are well known to one of ordinary skill in the art. For example, riser mechanisms are often used in deodorant canisters to push gel deodorant through top apertures in the canister.

The riser mechanism in the device 100 of the present invention comprises a riser 210, a riser shaft 230, and a shaft base 240. The riser 210 is slidably attached to the riser shaft 230. For example, the riser 210 has a threaded center aperture, which accommodates the threaded riser shaft 230 (e.g., the threaded riser shaft 230 is driven through the threaded center aperture of the riser 210). The riser 210 can be rotated in a first direction and a second direction about the riser shaft 230, causing the riser 210 to move upwardly or downwardly on the riser shaft 230. Or, when the riser shaft 230 is moved in a first direction and a second direction, the riser 210 is moved upwardly or downwardly on the riser shaft 230.

The riser shaft 230 and the riser 210 are disposed in the inner cavity of the tube 110. The riser shaft 230 spans a portion of the tube 110 from the second end upwardly toward the first end. The riser 210 is snugly in contact with the inner wall of the inner cavity of the tube 110 (e.g., in combination with a first gasket 220, e.g., an o-ring), and the substances or materials (e.g., putty, wood glue, etc.) are sandwiched between the riser 210 and the tip nozzle 130. Thus, when the riser 210 is moved upwardly (e.g., via rotating the riser shaft 230), the materials or substances are pushed out of the tip nozzle 130.

In some embodiments, a shaft base 240 is disposed on the outer end of the riser shaft 230. The shaft base 240 provides a surface for gripping and easily twisting the riser shaft 230.

In some embodiments, a base cap 140 is removably attached to the second end of the tube 110, and the threaded riser shaft 230 is threaded through a center aperture in the base cap 140. The base cap 140 may be threaded, enabling it to be screwed on and off the second end of the tube. In some embodiments, a second gasket 250 is sandwiched between the shaft base 240 and the base cap 140. The second gasket 250 has a central portion that penetrates the base cap 140 and flares out on the inner surface of the base cap 140. The central portion of the second gasket 250 penetrates and seals the center aperture between the base cap 140 and the threaded riser shaft 230. In some embodiments, the screw cap 120 and the base cap 140 are colored differently from the tube 110 (e.g., to differentiate them from the tube 110). In some embodiments, a holder 290 is attached to the riser shaft 230. The holder 290 may be alternatively snapped onto the riser shaft 230 (e.g., the riser shaft 230 slides through a central aperture of the holder 290. Disposed on the outer edge of the holder 290 is one or more slits.

In some embodiments, the nozzle tip 130 is inserted into the hole to repair and/or prepare the hole for filling. The nozzle tip 130 may be pressed into the interior of the hole, forcing paper and/or debris into the back of the hole. The material can be dispensed into the hole (e.g., via the riser mechanism) such that the material makes the wall or other surface flush and level.

As used herein, the term "about" refers to plus or minus 10% of the referenced number. For example, an embodiment wherein the tube 110 is about 5 inches in length includes a tube 110 that is between 4.5 and 5.5 inches in length.

The following the disclosures of the following U.S. Patents are incorporated in their entirety by reference herein: U.S. Pat. No. 5,186,949; U.S. Pat. No. 5,809,736; U.S. Pat. No. 4,465,648; U.S. Pat. No. 5,948,444; U.S. Pat. No. 7,021,913.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A hardware hole filling device comprising:

(a) a tube having a first end, a second end, and an inner cavity, the inner cavity holds a filling;

(b) a tip disposed on the first end of the tube, the tip is fluidly connected to the inner cavity of the tube;

(c) a tip nozzle removably attached to the tip of the tube;

(d) threads disposed on the first end of the tube;

(e) a screw cap for removably attaching to the tube via the threads, the screw cap functions to cover the tip nozzle when attached to the tube;

(f) a base cap removably attached to the second end of the tube; and (g) a riser mechanism functioning to push the filling from the inner cavity of the tube to the tip nozzle, the riser mechanism comprises: (i) a threaded riser shaft, (ii) a riser threaded on the riser shaft, and (iii) a shaft base, the threaded riser shaft is attached to the shaft base, the riser shaft extends into the inner cavity of the tube from the second end upwardly toward the first end, the riser is snugly in contact with an inner wall of the inner cavity of the tube, the filling is sandwiched between the riser and the tip nozzle and the shaft base is positioned externally to the second end of the tube and the base cap, the riser shaft can be moved in a first direction and a second direction by twisting the shaft base causing the riser to moved upwardly and downwardly, respectively, on the riser shaft, when the riser is moved upwardly the filling in the inner cavity of the tube is pushed to the tip nozzle, wherein a second gasket is sandwiched between the shaft base and the base cap, further a central portion of the second gasket penetrates the base cap and flares out on a inner surface of the base cap.

2. The device of claim 1, wherein the filling is spackle, putty, wood putty, drywall composition, or wood glue.

3. The device of claim 1, wherein the first end of the tube is beveled.

4. The device of claim 1, wherein the tip nozzle is generally cylindrical.

5. The device of claim 1, wherein the tip nozzle has a flat end.

6. The device of claim 1, wherein the riser is snugly in contact with the inner wall of the inner cavity of the tube in combination with a first gasket.

7. The device of claim 1, wherein a second gasket is sandwiched between the shaft base and the base cap.

* * * * *